US006588404B1

(12) United States Patent
Mathews

(10) Patent No.: US 6,588,404 B1
(45) Date of Patent: Jul. 8, 2003

(54) REDUNDANT SENSOR WITH CYLINDER SHUTDOWN

(75) Inventor: David Stewart Mathews, Howell, MI (US)

(73) Assignee: General Motors Corporation, Detroit, MI (US)

( * ) Notice: Subject to any disclaimer, the term of this patent is extended or adjusted under 35 U.S.C. 154(b) by 14 days.

(21) Appl. No.: 10/025,228

(22) Filed: Dec. 19, 2001

(51) Int. Cl.[7] ..... F02P 7/07

(52) U.S. Cl. ..... 123/479; 123/406.18; 123/406.62

(58) Field of Search ..... 123/479, 481, 123/406.62, 406.18, 406.47

(56) References Cited

U.S. PATENT DOCUMENTS

| | | | | | |
|---|---|---|---|---|---|
| 4,941,445 | A | * | 7/1990 | Deutsch | 123/479 |
| 5,343,842 | A | * | 9/1994 | Fukui | 123/479 |
| 5,345,909 | A | * | 9/1994 | Fukui et al. | 123/406.58 |
| 5,469,823 | A | * | 11/1995 | Ott et al. | 123/406.62 |
| 5,630,396 | A | * | 5/1997 | Fukui et al. | 123/406.18 |
| 5,647,322 | A | * | 7/1997 | Fukui et al. | 123/406.18 |
| 5,816,218 | A | * | 10/1998 | Motose | 123/406.18 |

* cited by examiner

*Primary Examiner*—Erick Solis
(74) *Attorney, Agent, or Firm*—Christopher DeVries

(57) ABSTRACT

A method of providing engine timing information for an engine having a plurality of cylinders including detecting a fault for a crankshaft sensor generating engine timing information with a camshaft sensor, providing spark and fuel with the engine timing information generated by the camshaft sensor, and shutting off fuel to at least one of the cylinders.

10 Claims, 4 Drawing Sheets

REDUNDANT SENSOR WITH CYLINDER SHUTDOWN

TECHNICAL FIELD

The present invention relates to the control of an internal combustion engine. More specifically, the present invention relates to controlling an internal combustion engine upon the failure of a crankshaft position sensor.

BACKGROUND OF THE INVENTION

Presently, automotive companies manufacture data or target wheels for use with speed sensors to detect the speed, timing, and position of an engine crankshaft and/or a camshaft. As is known in the art of four-cycle internal combustion engines (ICEs), position and timing information for a crankshaft and a camshaft is very important to the application and synchronization of spark and fuel. The crankshaft is actuated by combustion in the pistons, and the camshaft actuates the intake and exhaust valves of the pistons. A camshaft may be used in an overhead valve (OHV) configuration where the valves are actuated via pushrods, or in an overhead cam (OHC) configuration where the valves are acted on directly by the camshaft. The camshaft is driven by the crankshaft through a 1:2 reduction (i.e., two rotations of the crankshaft equal one rotation of the camshaft) and the camshaft speed is one-half that of the crankshaft. The crankshaft and camshaft position, for engine control purposes, are measured at a small number of fixed points, and the number of such measurements may be determined by the number of cylinders in the ICE.

In today's engine control systems, crankshaft speed supplied by a crankshaft sensor provides position, timing, and/or speed information to an electronic controller for controlling the application of spark and fuel to the cylinders of an ICE. The position and timing (phase) of a first camshaft controlling exhaust valves for a cylinder and/or a second camshaft controlling intake valves for a cylinder in an OHC engine may be controlled relative to the crankshaft (piston position) to reduce emissions and improve fuel economy. Several cam-phasing devices exist in today's automotive market that require accurate position and timing information provided by a camshaft position sensor.

A crankshaft or camshaft position sensing system typically includes a variable reluctance or Hall effect sensor positioned to sense the passage of a tooth, tab, and/or slot on a target or data wheel coupled to the crankshaft or camshaft. In a four-cycle ICE, the electronic controller must further differentiate the intake, compression, power, and exhaust strokes since the cylinders will be approaching top dead center (TDC) position during the compression and exhaust phases and approaching bottom dead center (BDC) position during the intake and power phases. Accordingly, the application of fuel and spark in a typical ICE will not be applied until enough position information has been obtained from the crank position sensing systems. Thus, the engine controller must not only determine the TDC and BDC positions of the cylinder but also the state of the engine cycle to control fuel and spark. In the event of a failure of the crankshaft position sensor or system, engine timing must somehow be determined to allow a vehicle to function well enough to travel to a destination where the failure can be fixed.

SUMMARY OF THE INVENTION

The present invention comprises a method and apparatus to allow a vehicle engine to operate in the event of a crankshaft sensor failure used in sensing systems common to four cycle ICEs, including but not limited to four-, five-, six- and eight-cylinder engines. The camshaft position sensing system of the present invention, specifically the sensor and target wheel used to provide position information for the camshaft and phasing of the camshaft, may be used to provide timing signals for control of fuel and spark in the event of a crankshaft sensor failure.

The present invention utilizes a 4× target wheel cam with four binary (state encoded) base periods for engine cam timing functions. Each semi-period or state is bounded by a rising and falling edge that are a fixed angle before TDC for one or more cylinders of all four, five, six, and eight cylinder engine configurations. For five- or six-cylinder engine configurations, a 4× target wheel used in a camshaft sensing system may not provide accurate information on the position of a particular cylinder/piston. If spark is applied too early to a cylinder (the cylinder is over-advanced by 20–30 degrees), a negative torque spike may occur. The negative torque spike can create stress on the crankshaft and be transmitted through the crankshaft to a starter motor. Starter motors are typically mounted by a flange to an engine block and are connected to the crankshaft through a coupling such as a gear box or belt. The negative torque spike created by the mis-timing of fuel and spark to an engine may destroy the starter motor coupling or fracture the engine block.

The present invention utilizes the 4× target wheel of the camshaft positioning system to provide backup or redundant information to an engine controller for engine timing. Furthermore, for certain engine types such as five-cylinder or six-cylinder engines, the application of spark and fuel for certain cylinders may be prevented to eliminate a negative torque spike. Fuel and spark are supplied to the engine sequentially, one cylinder at a time. When a position within a 720 degree engine cycle is reached where a fuel injector or ignition event for a cylinder can create an over-advance condition, ignition in that cylinder is prevented by turning off the fuel injector and/or spark ignition device. The absence of fuel and spark to that individual cylinder ensures that the cylinder does not produce any torque, positive or negative. All cylinders that cannot generate the over-advance condition are operated with normal fuel injection and spark events.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
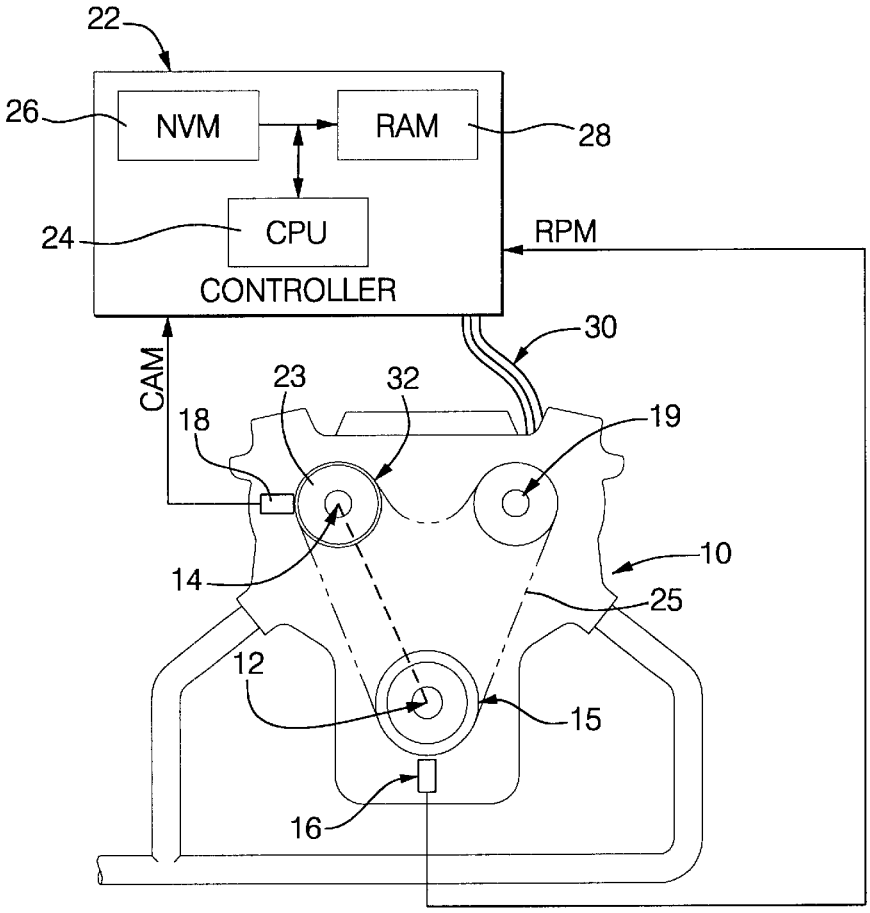
FIG. 1 is a diagrammatic drawing of the engine and cam sensing system of the present invention.

FIG. 1 illustrates an internal combustion engine 10 having a crankshaft 12. The speed of the crankshaft 12 is communicated in the form of periodic signals generated by the rotation of a target wheel 15 on the crankshaft 12 by a conventional wheel speed sensor 16. The wheel speed sensor 16 may comprise any known wheel speed-sensing device including, but not limited to, variable reluctance sensors, Hall effect sensors, optical switches and proximity switches. The purpose of the wheel speed sensor 16 is to detect the teeth on the target wheel 15 and provide a pulse train to an electronic controller 22. The electronic controller 22, in conjunction with other sensors, will determine the speed and position of the crankshaft 12 using the periodic signals generated by the speed sensor 16.

The vehicle controller 22 may be any known microprocessor or controller used in the art of engine control. In the preferred embodiment, the controller 22 is a microprocessor, having nonvolatile memory NVM 26 such as ROM, EEPROM, or flash memory, random access memory RAM 28, and a central processing unit CPU 24. The CPU 24 executes a series of programs to read, condition, and store inputs from vehicle sensors. The controller 22 uses various sensor inputs to control the application of fuel and spark to each cylinder through conventional spark and fuel injector signals 30. In the preferred embodiment of the present invention, the fuel injectors are configured as port injectors where each cylinder is supplied with fuel from a fuel injector. The controller 22 further includes calibration constants and software stored in NVM 26 that may be applied to control numerous engine types.

In the preferred embodiment of the present invention, as shown in FIG. 1, the engine 10 is shown with exhaust camshaft 14 and intake camshaft 19. The exhaust camshaft 14 and intake camshaft 19 are coupled to the crankshaft 12 via sprockets and a timing chain 25. The exhaust camshaft 14 actuates exhaust valves for the cylinders, and the intake camshaft 19 actuates intake valves for the cylinders, as is commonly known in the art. A target wheel 23 coupled to the exhaust camshaft 14 generates periodic signals using wheel position sensor 18 to provide speed and position information for the exhaust camshaft 14. The wheel position sensor 18 may be similar in functionality to wheel speed sensor 16.

The present invention may further be equipped with a continuously variable cam phaser 32, as is known in the art. The cam phaser 32 in the preferred embodiment may be coupled to the exhaust camshaft 14. In alternate embodiments of the present invention, a cam phaser 32 may be coupled to the intake camshaft 19 or to both the exhaust and intake camshafts 14, 19, depending on the desired performance and emission requirements of the engine 10. The cam phaser 32 is hydraulically modulated to create a variable rotational offset between the exhaust camshaft 14 and the intake camshaft 19. The degrees of rotational offset generated by the cam phaser 32 enables the ICE 10 to be tuned for specific performance requirements by varying valve overlap, i.e., overlap between the exhaust and intake valves of the engine 10.

Figure 2:
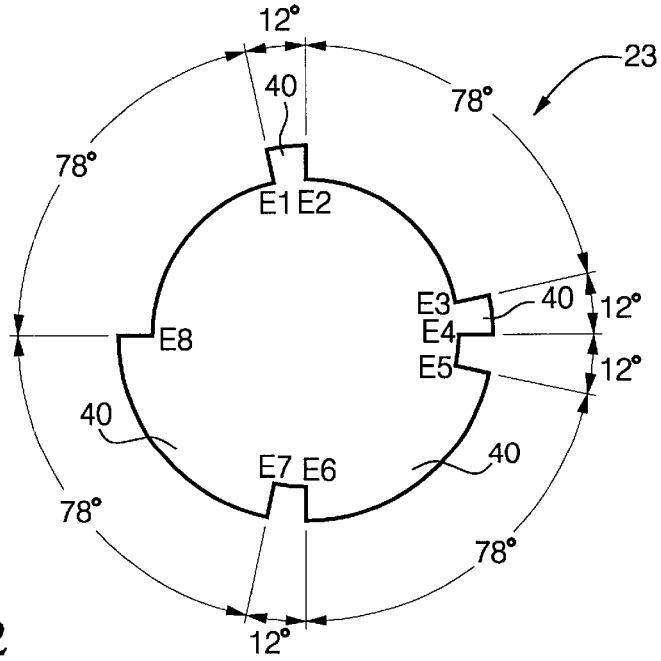
FIG. 2 is a diagrammatic drawing of a 4× target wheel used for camshaft position sensing in the present invention.

FIG. 2 is a diagram of the target wheel 23 of the preferred embodiment of the present invention that will be described in conjunction with a timing diagrams of FIGS. 3A, 3B and 3C. The target wheel 23 includes an irregular surface having teeth, slots, or tabs 40. The teeth 40 have edges E1–E8 for generating a pulse train for the wheel position sensor 18.

Figure 3A:
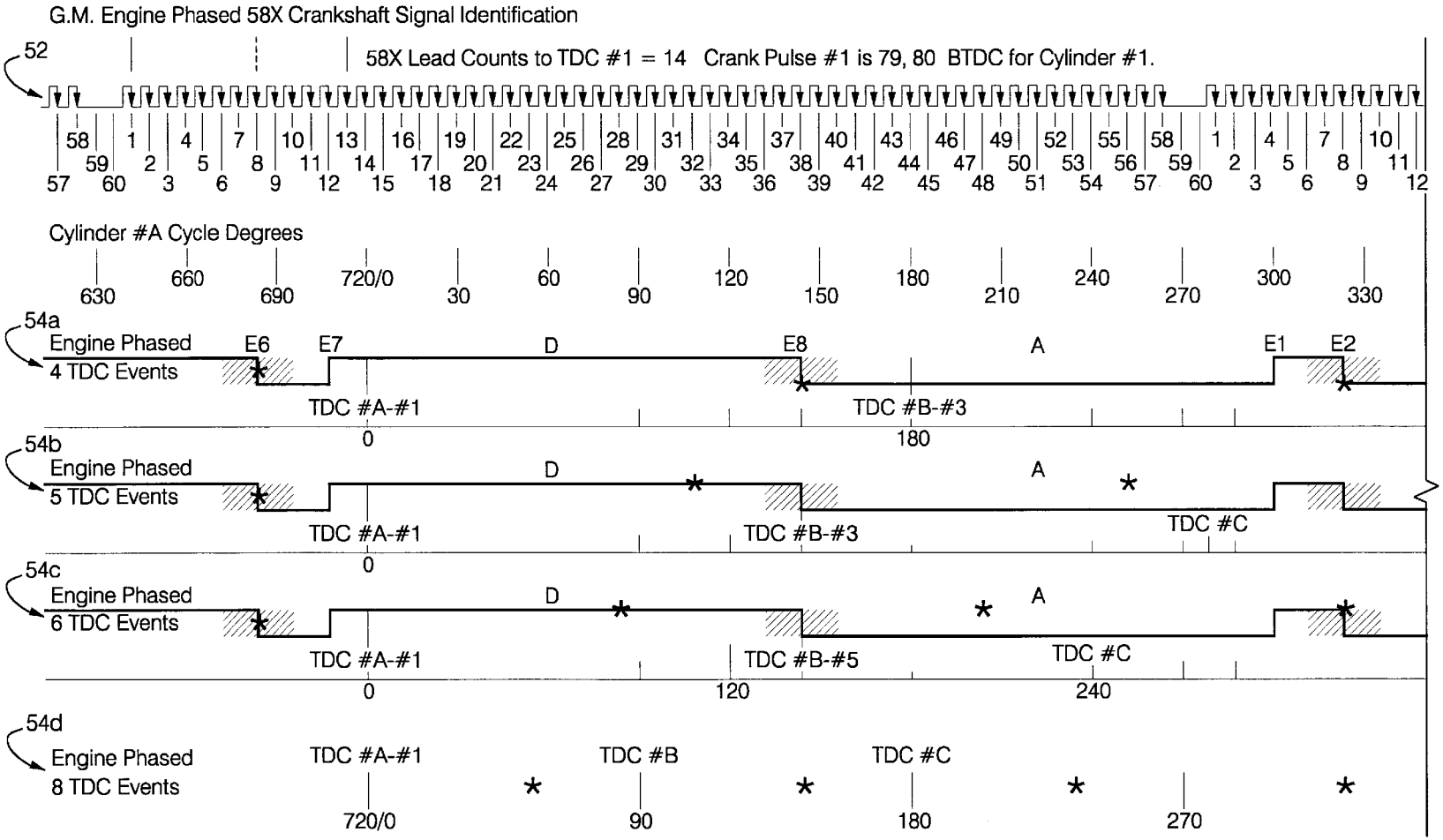
FIGS. 3A, 3B and 3C are timing diagrams illustrating the signals generated by the position sensing systems of the present invention.
Figure 3B:
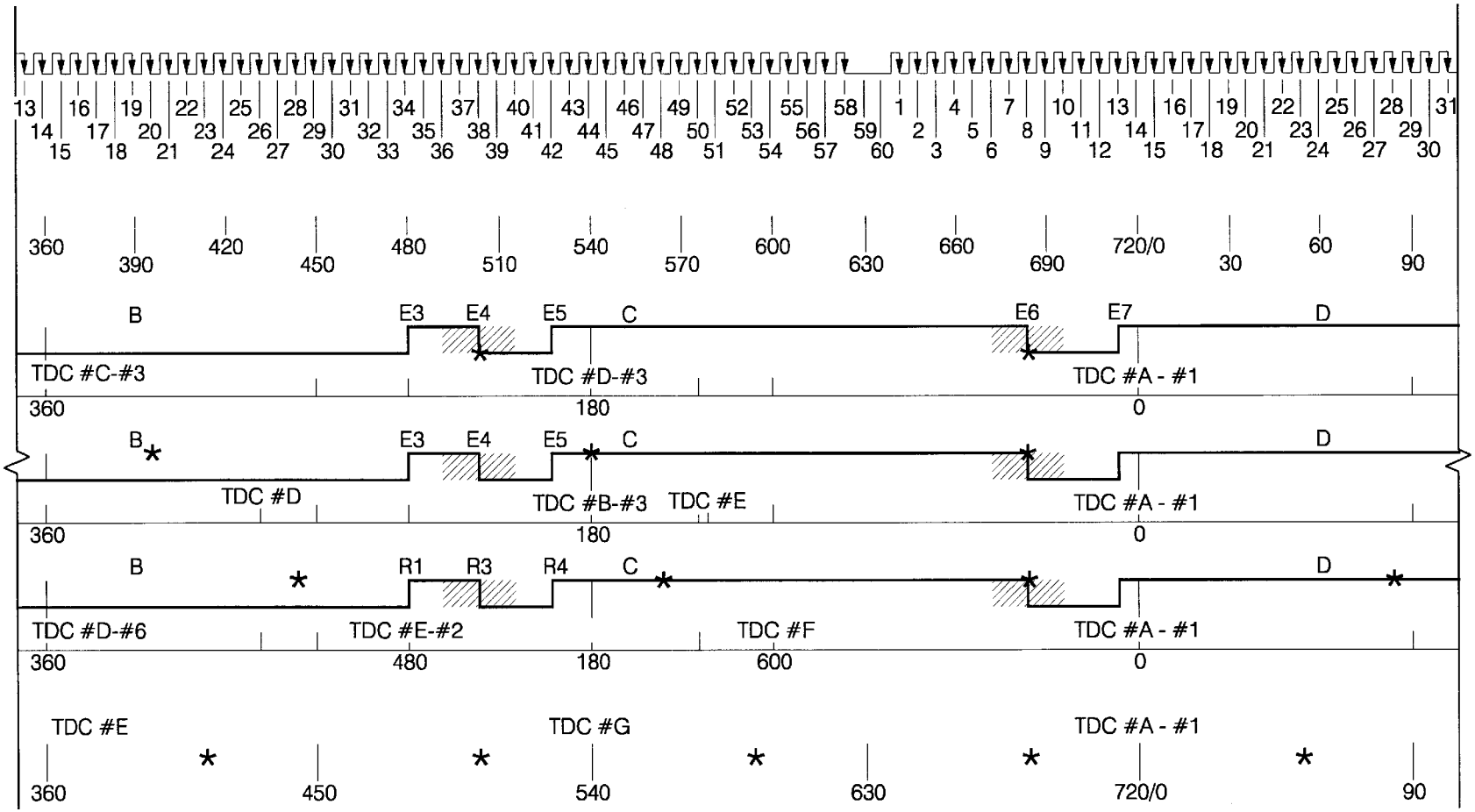
Figure 3C:
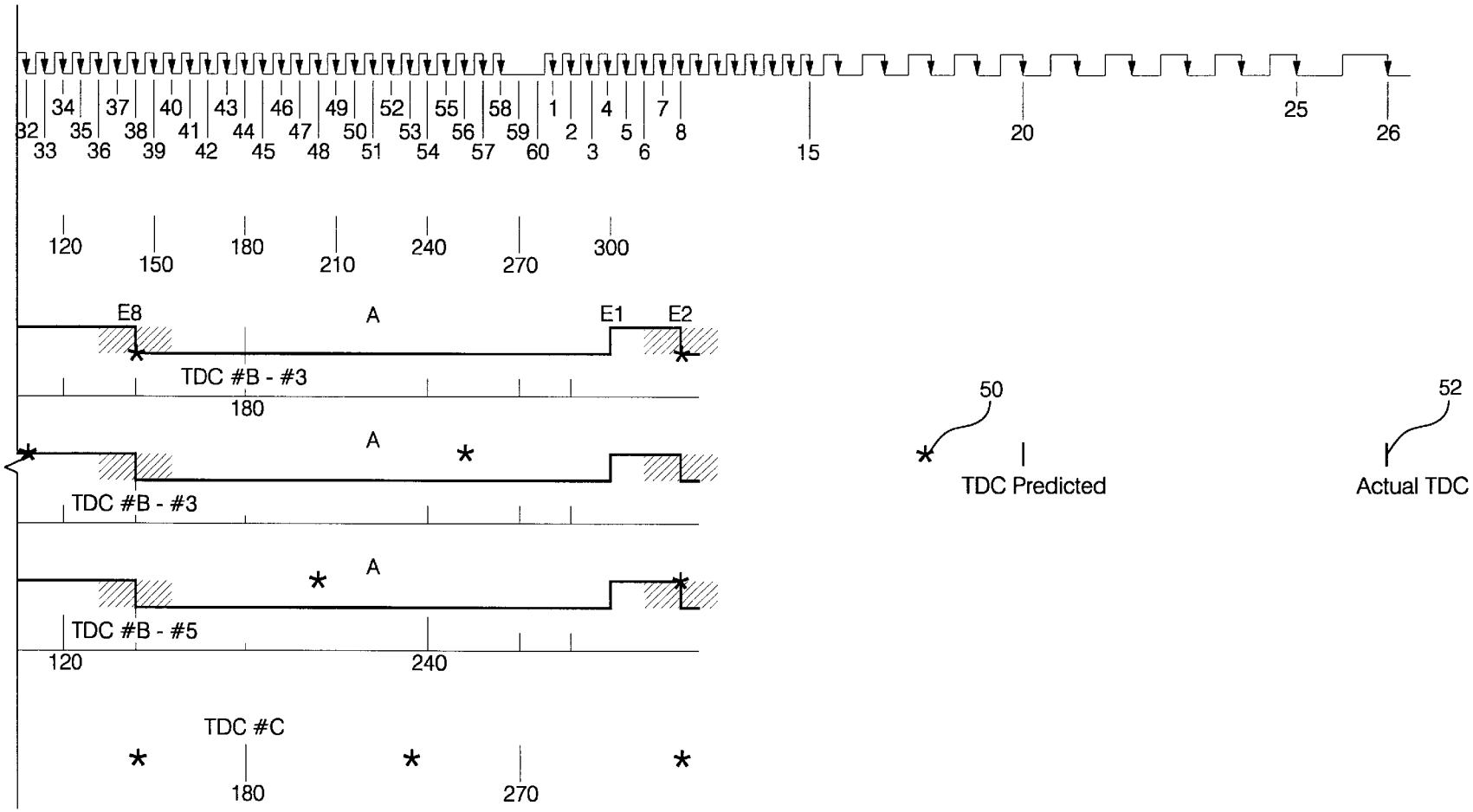

Referring to FIGS. 3A, 3B and 3C, a timing diagram is shown with a series of exhaust, intake and ignition events, a pulse train 52 generated by the target wheel 15 and target wheel sensor 16, and pulse trains 54 generated by the target wheel 23 and target wheel position sensor 18. Plot 54*a* corresponds to timing events for a four-cylinder engine, plot 54*b* corresponds to timing events for a five-cylinder engine, plot 54*c* corresponds corresponds to timing events for a six-cylinder engine, and plot 54*d* corresponds to timing events for an eight-cylinder engine. The pulse train 54 includes edges E1–E8 that correspond to the physical layout of the teeth 40 on target wheel 23. The edges E1–E8 signal the controller 22 the position and speed of the exhaust camshaft 14 and the state of the crankshaft 12 (i.e., is it in the compression or exhaust phase) and corresponding cylinders to allow the application of spark and fuel by the controller 22 in the case of a failure of target wheel sensor 16 for the crankshaft 12.

During the operation of an engine such as a five- or six-cylinder engine, the crankshaft target wheel sensor 16 may fail or other failures may occur that prevent timing information to be recorded from the target wheel sensor 16. In such cases, the vehicle may operate using the camshaft target wheel 23 and position sensor 18. The position information provided by the position sensor 18 can be used to determine the application of fuel and spark to the engine 10. A 4× target wheel such as target wheel 23 in certain situation may not provide reliable position and timing information for the engine 10. Referring to FIGS. 3A, 3B and 3C, plot 54*b* and edges E6, E8, E1, E2 and E5 will be used to provide crankshaft position information. Cylinders A, B, C, D and E for a five-cylinder engine can be referenced in plot 54*b* for a five-cylinder engine.

In the preferred embodiment of the present invention, the edges E6, E8, E1, E2, and E5 for a five-cylinder engine produce a signal thirty-six degrees from the TDC position for cylinder A, zero degrees from the TDC position for cylinder B, twelve degrees after the TDC position for cylinder C, one hundred-eight degrees from the TDC position for cylinder D, and forty-eight degrees from the TDC position for cylinder E. If the speed can be predicted correctly, accurate firing of spark and the application of fuel can be done with reference to the edges E6, E8, E1, E2, and E5. In certain operating conditions for the cylinder D, the engine 10 may slow down, as shown by the plot 52 in FIG. 3C. The predicted position 50 and actual position 52 of the piston may be inaccurate. The piston could be in an over-advanced position where negative torque will be generated by spark and fuel. In such a situation, spark and/or fuel may be cut off to that particular cylinder to prevent the negative torque spike.

When E2 is reached, this would be the normal event to turn on a fuel injector or set up a ignition event for cylinder D. However, since ignition at this event can cause an over-advance condition, cylinder D ignition is prevented by turning off the fuel injector and/or spark ignition device. The absence of fuel and spark to cylinder D ensures it does not produce any torque, positive or negative.

While this invention has been described in terms of some specific embodiments, it will be appreciated that other forms can readily be adapted by one skilled in the art. Accordingly, the scope of this invention is to be considered limited only by the following claims.

What is claimed is:

1. A method of providing engine timing information for an engine having a plurality of cylinders comprising:

detecting a fault for a crankshaft sensor;

generating engine timing information with a camshaft sensor;

providing spark and fuel with the engine timing information generated by the camshaft sensor; and shutting off fuel to at least one of the cylinders.

2. The method of claim 1 further comprising the step of shutting off spark to at least one of the cylinders.

3. The method of claim 1 wherein the step of generating timing information with a camshaft sensor comprises the steps of:

providing a 4× target wheel indicative of the position of a camshaft;

providing a target wheel sensor;

detecting the edges of the target wheel with the target wheel sensor; and estimating the position of a crankshaft based on the detected edges of the 4× target wheel.

4. The method of claim 1 wherein the step of shutting off fuel to at least one of the cylinders comprises:

determining if the at least one of the cylinders is too advanced to provide fuel; and shutting off a fuel injector supplying fuel to the at least one of the cylinders.

5. The method of claim 1 wherein said engine includes at least five cylinders.

6. An internal combustion engine comprising:

an intake manifold for providing air to the internal combustion engine;

a throttle plate controlling the flow of said air;

a fuel injector introducing fuel into said air to form an air-fuel mixture;

at least one piston for combusting said air-fuel mixture using a spark plug;

a plurality of valves to control intake and exhaust of said at least one piston;

a first camshaft having a plurality of lobes to actuate said exhaust valves;

a first position sensor detecting the position of said first camshaft;

a sprocket coupled to said first camshaft to drive said first camshaft;

a crankshaft to drive said sprocket;

a second position sensor detecting the position of said crankshaft;

wherein upon the failure of said second position sensor said first position sensor provides position information for the crankshaft; and wherein said first position sensor will determine if said at least one piston is overadvanced and prevent fuel from being supplied to said at least one piston.

7. The internal combustion engine of claim 6 wherein the internal combustion engine is a four-cycle engine.

8. The internal combustion engine of claim 6 wherein the internal combustion engine is a direct injection engine.

9. The internal combustion engine of claim 6 further comprising a second camshaft, said second camshaft controlling intake valves.

10. The internal combustion engine of claim 9 further comprising a cam phaser coupled to at least one of said first or second camshafts.

* * * * *